United States Patent [19]

Scaglia

[11] Patent Number: 4,944,146

[45] Date of Patent: Jul. 31, 1990

[54] METHOD TO CONVEY ROVING PACKAGES WITH THE ROVING PREPOSITIONED

[76] Inventor: Enzo Scaglia, Via Monte Rosa 21, Milano, Italy, 20149

[21] Appl. No.: 333,535

[22] Filed: Apr. 5, 1989

[30] Foreign Application Priority Data

Apr. 27, 1988 [IT] Italy ..... 83374 A/88

[51] Int. Cl.[5] ..... D01H 9/18

[52] U.S. Cl. ..... 57/281; 57/90; 242/35.5 A

[58] Field of Search ..... 57/90, 281; 242/35.5 A; 104/89

[56] References Cited

U.S. PATENT DOCUMENTS

| | | | |
|---|---|---|---|
| 4,438,622 | 3/1984 | Pons | 57/281 X |
| 4,720,967 | 1/1988 | Güttler | 57/90 X |
| 4,799,353 | 1/1989 | Kamasaki et al. | 57/90 X |

FOREIGN PATENT DOCUMENTS

| | | | |
|---|---|---|---|
| 0068120 | 1/1983 | European Pat. Off. . | |
| 213962 | 3/1987 | European Pat. Off. | 57/281 |
| 3611381 | 10/1987 | Fed. Rep. of Germany . | |
| 2523101 | 9/1983 | France . | |

*Primary Examiner*—Joseph J. Hail, III

*Attorney, Agent, or Firm*—Wegner & Bretschneider

[57] ABSTRACT

Method to convey roving packages (10-110) to feed spinning machines, the packages (10-110) being conveyed automatically to their working positions on the spinning machines by conveyor elements (12) on runways (13), package supports (11-111) being connected to the conveyor elements (12), the packages (10-110) being caused to arrive at their respective working positions on the spinning machines with the end of the roving (15-115) pre-positioned on roving supports (14-114-16-116) connected to the package supports (11-111), the end of the roving (15-115) having been extracted from the body of the packages (10-110) during the phase between the removal of the packages (10-110) from the package production machines and their transfer to the conveyor elements (12-13), the end of the roving (15-115) being positioned on the roving supports (14-114-16-116) substantially during the step of transfer of the packages (10-110) onto their respective package supports (11-111).

8 Claims, 2 Drawing Sheets

METHOD TO CONVEY ROVING PACKAGES WITH THE ROVING PREPOSITIONED

Figure 1A:
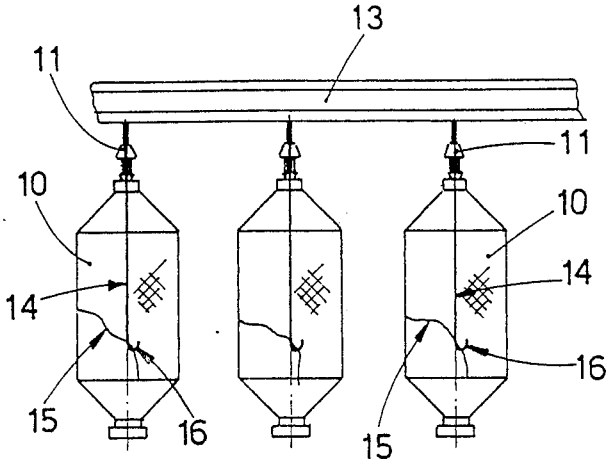

This invention concerns a method to convey roving packages with the roving pre-positioned. To be more exact, the invention concerns a method which arranges to convey packages to feed spinning machines, the roving of the packages being pulled out therefrom and positioned on a suitable roving support.

The method is applicable to systems for the automatic feed of packages to the creels of spinning machines, such systems carrying out the automatic replacement of exhausted packages on the spinning machines.

The state of the art includes many methods and devices suitable to convey and replace feed packages on the creels of spinning machines.

The known embodiments entail varying degrees of complexity and comprise proposals for working simplifications to assist the machine operatives and also proposals of a fully automated type.

The most widespread of the known embodiments involve the conveying of full packages to the spinning machine by means of suitable runways and connected conveyor means as soon as the packages on the spinning machine are exhausted or almost exhausted.

The same runways may also be employed to remove the exhausted or almost exhausted packages or the empty or almost empty tubes.

In such most widespread cases, when the full packages have been positioned on the spinning machine, the runways and the connected conveyor means themselves become the supply creel for the spinning machine.

The machine operatives take steps to find the end of the roving on each package, unwind it and introduce it into the drafting unit.

The finding of the end of the roving is a wasteful operation from the point of view of the effort required of the machine operatives in view of the position of the packages on the spinning machines.

This operation entails also a waste of time which could be employed otherwise, together with the related costs arising therefrom.

The purpose of the present applicant is to find a method able to overcome the problem of searching For the end of the roving on packages to feed spinning machines, to reduce considerably the overall time required for the replacement of exhausted packages and to reduce the fatigue of the machine operatives.

The invention is set forth in the main claim, while the dependent claims disclose various features of the invention.

The method according to the invention arranges to bring to the spinning machines feed packages with the roving already partly unwound by a required length and located on a roving support suitable to hold it in a required, pre-set position.

This position can be reached easily by the machine operatives, who merely have to rotate the packages by an amount necessary to free a further segment of roving for introduction into the drafting unit.

In the case of cylindrical yarn packages the roving can be merely positioned on the flat upper surface of the packages and be allowed to hang free along a desired segment.

The method provides for the roving to be pulled from the package advantageously during the step when the package, already taken from a speed frame for instance, is raised by suitable lifting means for insertion into its support.

The package support, which may be of a known pendular type for instance, is connected to conveyor means introduced into runways, which feed the spinning machines automatically with full packages and also take exhausted or almost exhausted packages from the spinning machines.

The means which extract the roving from the package body are connected to means which lift the package, and also arrange for the positioning of the extracted roving on a roving support solidly fixed to the package support.

This operation to position the roving is carried out when the package lifting means have inserted or are about to insert the package into its pendular support.

The roving support keeps the end of the roving detached from the package body and holds it in that position during the conveying of the package to its assigned position on the spinning machine.

The roving support performs also the task of a guide for the passage of the roving during the actual spinning step.

Extraction of the roving from the package may be carried out on only one package at a time or on several packages at one and the same time, depending on the extraction and lifting means included and on the rows of packages provided to feed the spinning machines.

When the packages come from a finisher box, the two rovings in the package are positioned together on one single roving support, thus allowing the machine operatives to have the easy task of dividing the rovings when introducing them into the drafting unit.

The method provides for the extraction of the roving and its positioning after extraction on its own support to take place in other phases of the cycle of conveying the packages to the spinning machines.

For instance, if intermediate storage points for full packages are provided between the package production machines and the spinning machines, then this operation can be carried out in the step of taking full packages from such storage points and transferring them to the conveyor means which supply the spinning machines.

Figure 1B:
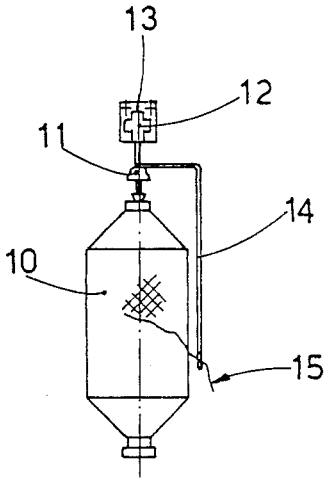
Figure 2A:
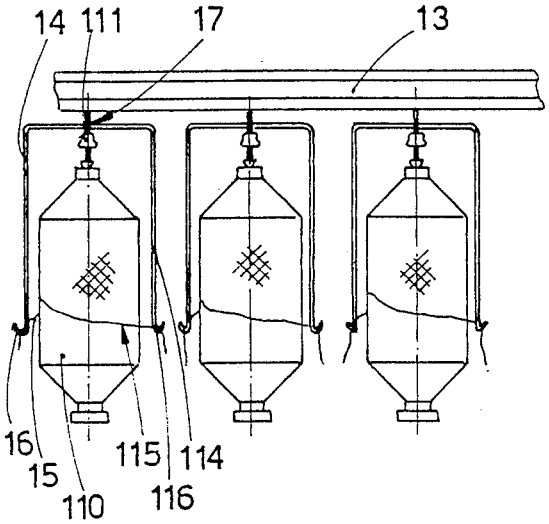
Figure 2B:
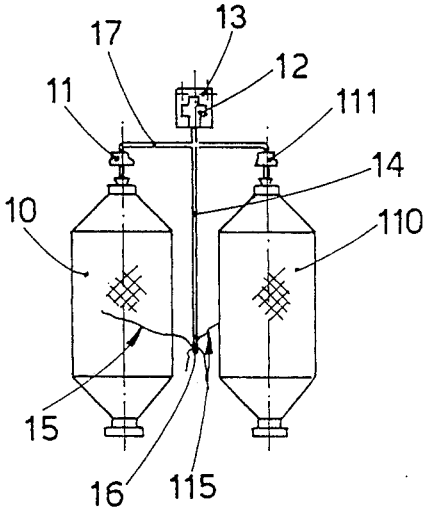
Figure 3:
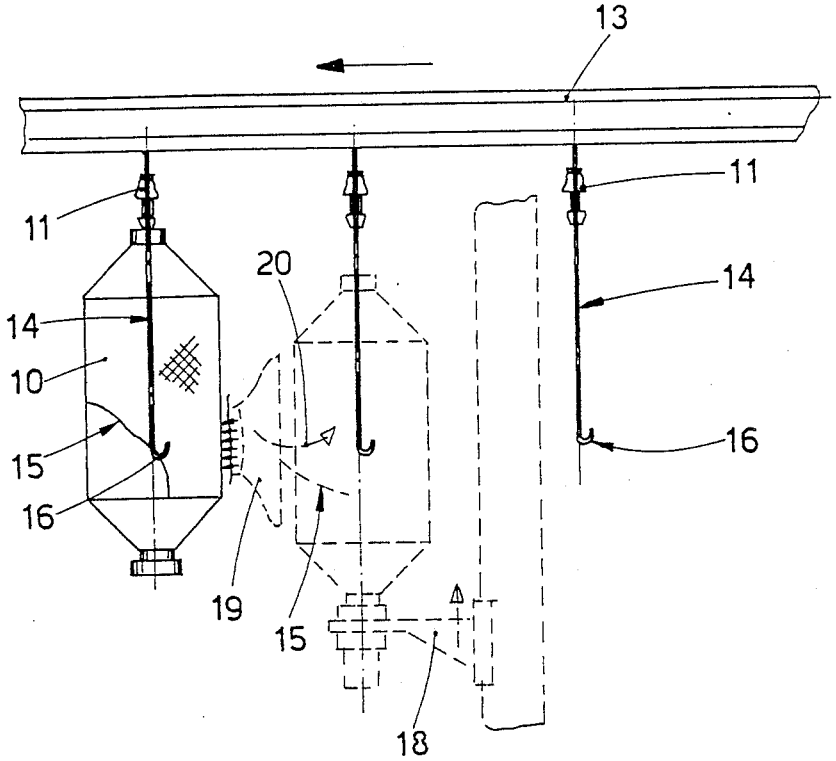
Figure 3:
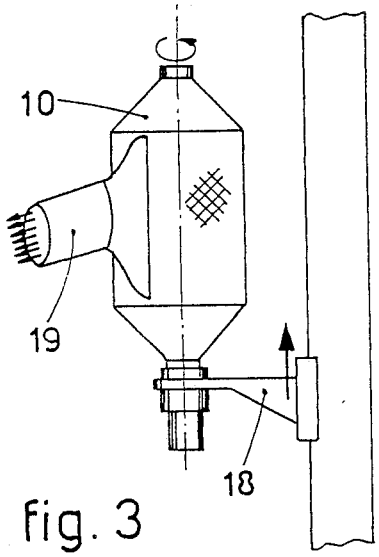

The attached figures, which are given as a non-restrictive example, show the following:

FIGS. 1*a* and 1*b* give diagrammatic side and front views of a type of positioning of the roving according to the invention;

FIGS. 2*a* and 2*b* show another type of positioning of the roving in side and front views according to the invention;

FIG. 3 gives a diagram of an operation for extraction and positioning of the roving according to the invention.

FIGS. 1*a* and 1*b* show how roving packages 10 are arranged in a preferred embodiment of the invention when they are ready to feed a spinning machine.

The roving packages 10 are borne on a package support 11 connected to conveyor means 12 located in runways 13.

A roving support 14 for roving 15 is connected to each package support 11 and comprises a terminal hook 16 to support and position the roving 15.

The roving support 14 is solidly fixed to the package support 11 and keeps the roving 15 separated from the body of the package 10 in a stationary pre-set position.

In this example the roving support 14 is shaped as an "L" upside-down so as to reduce to a minimum the overall volume, in a horizontal plane, of a package 10 plus roving support 14 and extends vertically to a position where it is easiest for the machine operatives to grasp the roving 15.

The roving support 14 can be positioned on the package support 11 in at least two positions at 180° to each other and thus can be arranged to feed alternately in the same conditions either one or the other of the two sides of the spinning machine.

FIGS. 2*a* and 2*b* show a lay-out whereby one single runway 13 with connected conveyor means 12 enables pairs of packages 10 and 110 to be moved.

The pairs of packages 10-110 are supported on their respective package supports 11-111 connected together by a frame 17, which in turn is connected to the conveyor means 12.

The roving support, here shaped as a "U" upside-down, forms part of the frame 17 and consists of two connected segments 14 and 114 to support the rovings 15 and 115 of the packages 10 and 110 respectively.

Each support segment 14-114 includes a terminal hook 16 and 116 to hold the respective rovings 15-115.

FIG. 3 shows diagrammatically a possible cycle of extraction of the roving 15 from the package 10 during the step of transfer of the package 10 from its production machine to the runway 13.

The packages 10 are positioned on an elevator means 18, which comprises an aspiration intake 19 to aspirate the roving 15 from the body of the package 10.

The package 10 is positioned on the elevator means 18 with its axis coinciding advantageously with the axis of the package support 11, so that it can be positioned on the package support 11 automatically at the end of its upward travel.

During this travel the package 10 is made to rotate about its own axis so as to assist engagement of the roving 15 by the aspiration intake 19.

Before being attached to its package support 11, the package 10 stops rotating about its axis, while the aspiration intake 19 is distanced from the body of the package 10 and retains the aspirated roving 15 (position shown in FIG. 3 with lines of dashes).

When the package 10 has been attached to its package support 11, the aspiration intake 19 is moved to a suitable position in relation to the roving support 14, for instance as shown with the arrow 20, so as to enable the roving 15 to be positioned on the hook 16 when the aspiration of the intake 19 is stopped.

During this step the conveyor means 12 of the runway 13 are halted; when the attachment of the package 10 to the package support 11 is completed and the roving 15 has been positioned on its hook 16, the conveyor means 12 are advanced by one step to start a new cycle of extraction of the roving 15 and of attachment of the package 10.

In the example of FIGS. 2 aspiration intakes 19 suitable to operate on pairs of coupled packages 10-110 will be included on the elevator means 18.

I claim:

1. Method of automatically positioning a roving package for feeding a roving to a spinning machine comprising:

(a) removing the roving package from a package production machine, (b) removing an end portion of the roving from the roving package, (c) transferring the roving package to a package support, wherein said package support is connected to a conveyor means, (d) positioning the end portion of the roving onto a roving support substantially during the step of transferring the roving package to the conveyor means, and (e) conveying the roving package to a working position on the spinning machine.

2. Method of automatically positioning a roving package as in claim 1, wherein the end portion of the roving is removed from the roving package by an aspiration means.

3. Method of automatically positioning a roving package as in claim 2, wherein the roving package is rotated as the end portion of the roving is removed by the aspiration means.

4. Method of automatically positioning a roving package as in claim 3, wherein the roving is positioned onto the roving support by moving the aspiration means in relation to the roving support.

5. Method of automatically positioning a roving package as in claim 1, wherein the roving support is a hook.

6. Method of automatically positioning a roving package as in claim 1, wherein the roving package is transferred to the package support by an elevator means.

7. Method of automatically positioning a roving package as in claim 1, wherein the roving package is produced on a speed frame.

8. Method of automatically positioning a roving package as in claim 1, wherein the roving package is produced on a finisher box.

* * * * *